US010230157B2

(12) United States Patent
Wang et al.

(10) Patent No.: US 10,230,157 B2
(45) Date of Patent: Mar. 12, 2019

(54) WIFI AND GPS ANTENNA

(71) Applicant: Beijing Xiaomi Mobile Software Co., Ltd., Beijing (CN)

(72) Inventors: Linchuan Wang, Beijing (CN); Zonglin Xue, Beijing (CN); Xiaofeng Xiong, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 3 days.

(21) Appl. No.: 15/412,313

(22) Filed: Jan. 23, 2017

(65) Prior Publication Data

US 2017/0279184 A1 Sep. 28, 2017

(30) Foreign Application Priority Data

Mar. 23, 2016 (CN) ..... 2016 1 0169910

(51) Int. Cl.
*H01Q 1/24* (2006.01)
*H01Q 1/48* (2006.01)
(Continued)

(52) U.S. Cl.
CPC ..... *H01Q 1/243* (2013.01); *H01Q 1/48* (2013.01); *H01Q 5/335* (2015.01); *H01Q 5/371* (2015.01);
(Continued)

(58) Field of Classification Search
CPC ..... H01Q 1/243; H01Q 5/371; H01Q 5/335; H01Q 9/42; H01Q 7/00; H01Q 1/48; H01Q 9/045
See application file for complete search history.

(56) References Cited

U.S. PATENT DOCUMENTS

2012/0112969 A1 5/2012 Caballero et al.
2012/0214412 A1* 8/2012 Schlub ..... H01Q 1/243 455/41.1
(Continued)

FOREIGN PATENT DOCUMENTS

CN 103117452 A 5/2013
CN 104064865 A 9/2014
(Continued)

OTHER PUBLICATIONS

International Search Report and Written Opinion issued by the State Intellectual Property Office of the People's Republic of China (SIPO) dated Dec. 21, 2016, in counterpart International Application No. PCT/CN2016/100647.
(Continued)

*Primary Examiner* — Hai V Tran
*Assistant Examiner* — Michael M Bouizza
(74) *Attorney, Agent, or Firm* — Finnegan, Henderson, Farabow, Garrett & Dunner LLP

(57) ABSTRACT

A WIFI & GPS antenna applied to a mobile terminal with a metallic body. The metallic body includes a metallic body part and a receiving zone located above the metallic body part. The WIFI & GPS antenna includes a feeding point and a ground point each disposed on the metallic body part, and a capacitive tuning component connected to a top edge of the receiving zone, and connected to the feeding point in series. The receiving zone includes a component zone and an antenna zone. The feeding point, the ground point, and the capacitive tuning component are disposed in the antenna zone. A part of the top edge of the receiving zone operates as a radiator for the WIFI & GPS antenna.

5 Claims, 1 Drawing Sheet

(51) Int. Cl.

| | |
|---|---|
| ***H01Q 7/00*** | (2006.01) |
| ***H01Q 9/04*** | (2006.01) |
| ***H01Q 9/42*** | (2006.01) |
| ***H01Q 5/335*** | (2015.01) |
| ***H01Q 5/371*** | (2015.01) |

(52) U.S. Cl.
CPC ..... *H01Q 7/00* (2013.01); *H01Q 9/045* (2013.01); *H01Q 9/42* (2013.01)

(56) References Cited

U.S. PATENT DOCUMENTS

| | | | | |
|---|---|---|---|---|
| 2013/0154900 | A1 | 6/2013 | Tsai et al. | |
| 2013/0257659 | A1 | 10/2013 | Darnell et al. | |
| 2015/0084817 | A1* | 3/2015 | Yong ..... | H01Q 1/243 343/702 |

FOREIGN PATENT DOCUMENTS

| | | | |
|---|---|---|---|
| CN | 105244598 | A | 1/2016 |
| EP | 2 993 730 | A1 | 3/2016 |

OTHER PUBLICATIONS

English translation of International Search Report issued by the State Intellectual Property Office of the People's Republic of China (SIPO) dated Dec. 21, 2016, in counterpart International Application No. PCT/CN2016/100647.

Extended European Search Report issued by the European Patent Office dated Jul. 5, 2017, in counterpart European Patent Application No. 16205123.9-1927.

* cited by examiner

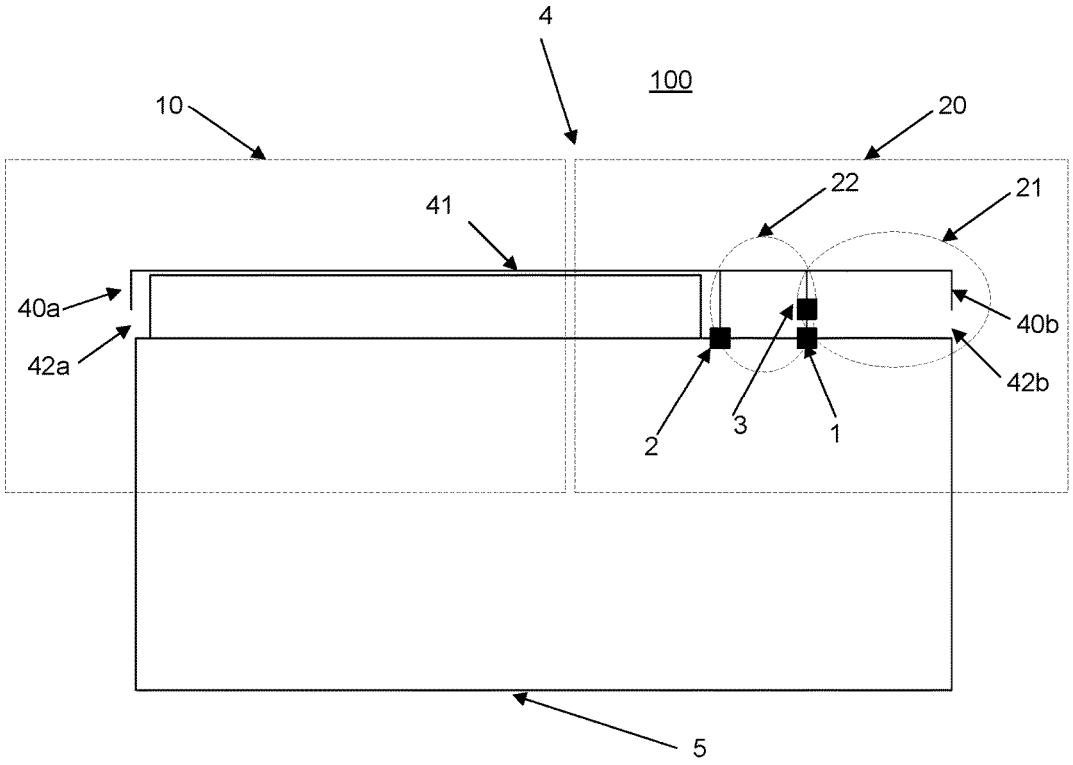
4
100
10
20
22
21
41
40a
40b
42a
42b
2
3
1
5

WIFI AND GPS ANTENNA

CROSS-REFERENCE TO RELATED APPLICATIONS

This application is based on and claims priority to Chinese Patent Application No. 201610169910.1, filed on Mar. 23, 2016, the entire contents of which are incorporated herein by reference.

FIELD

The present disclosure relates to an antenna and, more particularly, to a WIFI & GPS antenna.

BACKGROUND

With an increase of metallic elements in a mobile phone, a metallic body of the mobile phone has become a main trend of mobile phone appearance. However, the increase of metallic elements may lead to a decrease of a clearance zone of an antenna and may affect transmission and receipt of signals by the antenna, which is a challenge for designing antenna.

From a perspective of the performance of a single antenna, the bigger the clearance zone and the lesser the metal elements around the antenna, the better the antenna performance. Thus, in terms of a mobile phone with a metallic frame, better performance may be realized if the metallic frame is regarded as a part of the antenna.

Generally, because Global Positioning System (GPS) signals have a lower frequency (e.g., 1575 MHz) and a longer wavelength, a middle zone of an opened frame may be used as a part of the antenna. However, metallic components (such as a receiver, a front-facing camera, etc.) may be disposed in the middle zone, which may affect the performance of GPS. Therefore, a new antenna with improved performance without increasing a space for the antenna is desired.

SUMMARY

In order to overcome defects in the related art, embodiments of the present disclosure provide a WIFI & GPS antenna.

Specifically, a WIFI & GPS antenna applied to a mobile terminal with a metallic body is provided. The metallic body includes a metallic body part and a receiving zone located above the metallic body part. The receiving zone includes a left side edge, a right side edge, and a top edge connected to the left side edge and the right side edge. Each of the left side edge and the right side edge is provided with a slit. The WIFI & GPS antenna comprises: a feeding point and a ground point each disposed on the metallic body part, and a capacitive tuning component connected to the top edge of the receiving zone, and connected to the feeding point in series. The receiving zone includes a component zone and an antenna zone. and the feeding point, the ground point, and the capacitive tuning component are disposed in the antenna zone. A part of the top edge of the receiving zone operates as a radiator for the WIFI & GPS antenna.

BRIEF DESCRIPTION OF THE DRAWINGS

FIG. 1 is a schematic diagram of a WIFI & GPS antenna according to an example embodiment.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the disclosure. Instead, they are merely examples of apparatuses and methods consistent with aspects related to the disclosure as recited in the appended claims.

Terms used in the description of the present disclosure are only for the purpose of describing specific embodiments, and should not be construed to limit the present disclosure. As used in the description of the present disclosure and the appended claims, "a" and "the" in singular forms mean including plural forms, unless clearly indicated in the context otherwise. It should also be understood that, as used herein, the term "and/or" represents and contains any one and all possible combinations of one or more associated listed items.

Terms such as first, second or third may be used to describe various information but the information is not limited by the above terminologies. The above terminologies are used to distinguish one type of information from the other type of information, for example, first information may be referred to as second information without departing from a scope in accordance with the concept of the present disclosure and similarly, second information may be referred to as first information. As used herein, the term "if" may be construed to mean "when" or "upon" or "in response to determining" depending on the context.

Referring to FIG. 1, a WIFI & GPS antenna applied to a mobile terminal with a metallic body 100 is provided. In the present disclosure, a WIFI & GPS antenna is an antenna for transmitting and receiving WIFI and GPS signals. The WIFI & GPS antenna includes a feeding point 1 and a ground point 2. The metallic body 100 of the mobile terminal includes a metallic body part 5 and a receiving zone 4 located above the metallic body part 5. The receiving zone 4 includes a left side edge 40*a*, a right side edge 40*b*, and a top edge 41 connected to both of the left side edge 40*a* and the right side edge 40*b*. Each of the left side edge 40*a* and the right side edge 40*b* is provided with a slit 42*a* or 42*b*. The feeding point 1 and the ground point 2 of the WIFI & GPS antenna are disposed on the metallic body part 5. A capacitive tuning component 3 connected to the top edge 41 is disposed above the feeding point 1 and connected to the feeding point 1 in series. The receiving zone 4 includes a component zone 10 and an antenna zone 20. The feeding point 1 and the ground point 2 are disposed in the antenna zone 20 away from the component zone 10. In the illustrated embodiment, the structure between the feeding point 1, the ground point 2, the capacitive tuning component 3, the right side edge 40*b*, the top edge 41, and the slit 42*b* constitute the WIFI & GPS antenna in the antenna zone 20.

The capacitive tuning component 3 may be a capacitor with a capacitance ranging between 0.1 PF and 1.5 PF. The larger the capacitance, the shorter the path length of the WIFI & GPS antenna, but the radiant efficiency of WIFI & GPS antenna may be decreased and the usage of antenna may be affected. Preferably, the capacitor with the capacitance equal to 0.5 PF is selected for the capacitive tuning component 3 in embodiments of the present disclosure.

In embodiments of the present disclosure, the capacitive tuning component 3 is provided in the mobile terminal, and the ground point 2 is disposed on a side of the feeding point 1, so that the WIFI & GPS antenna may each use a part of the top edge 41 as an irradiator without undergoing the effect of a component disposed in the middle, and thus improving performance of the WIFI & GPS antenna.

The feeding point 1 is disposed near the slit 42*b* of the right side edge 40*b*. The feeding point 1, a part of the top edge 41, and the slit 42*b* of the right side edge 40*b* form an Inverted-F Antenna (IFA) antenna 21 for transmitting a WIFI signal. Such antenna for transmitting the WIFI signal (hereinafter referred to as a "WIFI antenna") fully utilizes a tail end of the slit 42*b*, so that a path length of the WIFI antenna is shortened.

The ground point 2 is disposed at a position in the antenna zone 20 and near the component zone 10. The feeding point 1, a part of the top edge 41, and the ground point 2 form a Loop antenna 22 for transmitting a GPS signal. As the capacitive tuning component 3 is disposed between the feeding point 1 and a metallic frame of the metallic body 100, an overall path length of the GPS antenna may be shortened effectively. One or more ground points can be disposed on a side of the ground point 2 near the component zone 10, so as to improve isolation of the WIFI & GPS antenna from other antennas on a left side thereof, or to reduce an adverse effect of a metallic component on antenna usage environment.

An overall length of a path between the feeding point 1 and the ground point 2 is less than a half-wavelength of a GPS working frequency.

A width of each slit 42*a* or 42*b* ranges between 0.5 mm and 1.5 mm. Preferably, the width is 0.8 mm in embodiments of the present disclosure. An effect of radiating may be affected if the width is too narrow, while it may lead to a poor appearance of a mobile phone if the width is too wide.

The exemplary embodiments are merely preferable embodiments of the present disclosure but are not interpreted to be limited to the embodiments of the present disclosure, and it should be understood that the present disclosure covers all the modifications, equivalent replacements and improvement within the spirit and technical scope of the present disclosure.

What is claimed is:

1. A WIFI & GPS antenna applied to a mobile terminal with a metallic body, wherein the metallic body includes a metallic body part and a receiving zone located above the metallic body part, the receiving zone includes a left side edge, a right side edge, and a top edge connected to the left side edge and the right side edge, and each of the left side edge and the right side edge is provided with a slit, the WIFI & GPS antenna comprising:

a feeding point and two or more ground points each disposed on the metallic body part of the mobile terminal; and a capacitive tuning component connected to the top edge of the receiving zone, and connected to the feeding point in series, the capacitive tuning component comprises a capacitor with a capacitance ranging between 0.1 PF and 1.5 PF;

wherein the receiving zone includes a component zone and an antenna zone, the feeding point, the two or more ground points, and the capacitive tuning component are disposed in the antenna zone;

a part of the top edge of the receiving zone operates as a radiator for the WIFI & GPS antenna;

the feeding point is disposed near the slit of the right side edge, and a first part of the top edge of the receiving zone, the feeding point, and the slit of the right side edge form an Inverted-F antenna (IFA) antenna for transmitting a WIFI signal; and the two or more ground points are disposed near the component zone, and the feeding point, a respective second part of the top edge of the receiving zone, and each of the two or more ground points form two or more loop antennas to transmit a GPS signal.

2. The WIFI & GPS antenna according to claim 1, wherein the capacitive tuning component is a capacitor with a capacitance equal to 0.5 PF.

3. The WIFI & GPS antenna according to claim 1, wherein each overall path length between the feeding point and each of the two or more ground points is less than a half-wavelength of a GPS working frequency.

4. The WIFI & GPS antenna according to claim 1, wherein a width of each slit ranges between 0.5 mm and 1.5 mm.

5. The WIFI & GPS antenna according to claim 4, wherein the width of each slit is 0.8 mm.

* * * * *